US009273920B2

(12) United States Patent
Clarke et al.

(10) Patent No.: US 9,273,920 B2
(45) Date of Patent: Mar. 1, 2016

(54) INTEGRAL MULTI-CHAMBERED VALVED SUPPRESSOR

(71) Applicant: The United States of America as represented by the Secretary of the Navy, Washington, DC (US)

(72) Inventors: Brandon Clarke, Bloomington, IN (US); Jason Davis, Loogootee, IN (US); Brian Kaneen, Bedford, IN (US); Steven Seghi, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/561,502

(22) Filed: Dec. 5, 2014

(65) Prior Publication Data

US 2016/0010935 A1 Jan. 14, 2016

Related U.S. Application Data

(60) Provisional application No. 61/921,723, filed on Dec. 30, 2013.

(51) Int. Cl.
*F41A 21/30* (2006.01)
*F41A 21/28* (2006.01)

(52) U.S. Cl.
CPC ..... *F41A 21/30* (2013.01); *F41A 21/28* (2013.01)

(58) Field of Classification Search
CPC ..... F41A 21/30; F41A 21/28
USPC ..... 86/14.2–14.4
See application file for complete search history.

(56) References Cited

U.S. PATENT DOCUMENTS

| | | | | | |
|---|---|---|---|---|---|
| 1,140,578 | A * | 5/1915 | Coulombe | F41A 21/30 | 181/223 |
| 1,315,504 | A * | 9/1919 | Humm | F41A 21/36 | 42/71.01 |
| 1,487,214 | A * | 3/1924 | Dezendorf | F41A 1/00 | 102/435 |
| 3,399,597 | A * | 9/1968 | Perrine | F41A 21/30 | 181/223 |
| 3,665,804 | A * | 5/1972 | Rohr | F41A 21/28 | 89/14.3 |
| 3,858,481 | A * | 1/1975 | Elliott | F41A 21/28 | 89/14.3 |
| 2014/0157640 | A1* | 6/2014 | Whelan | F41A 21/30 | 42/75.02 |
| 2015/0090105 | A1* | 4/2015 | Pace | F41A 21/30 | 89/14.4 |

* cited by examiner

*Primary Examiner* — Reginald Tillman, Jr.
(74) *Attorney, Agent, or Firm* — Christopher A. Monsey

(57) ABSTRACT

A suppression system adapted to receive gas from a gas operated system and route the gas through a series of multiple chambers having baffles and/or valves as well as expansion chambers where the chambers are formed around a gas projectile barrel and adapted to route the gas in a first route along the barrel in a first direction then routing the gas along the barrel in a second direction. An embodiment of the invention couples the chambers to a gas block adapted to route gas between the chambers in the first and second route as well as receive gas from the projectile barrel and route it to the gas operated system. Methods of manufacturing and methods of use are also provided.

45 Claims, 8 Drawing Sheets

INTEGRAL MULTI-CHAMBERED VALVED SUPPRESSOR

CROSS-REFERENCE TO RELATED APPLICATIONS

The present application claims priority to U.S. Provisional Patent Application Ser. No. 61/921,723, filed Dec. 30, 2013, entitled "INTEGRAL MULTI-CHAMBERED VALVED SUPPRESSOR," the disclosure of which is expressly incorporated by reference herein.

STATEMENT REGARDING FEDERALLY SPONSORED RESEARCH OR DEVELOPMENT

The invention described herein includes contributions by one or more employees of the Department of the Navy made in performance of official duties and may be manufactured, used and licensed by or for the United States Government for any governmental purpose without payment of any royalties thereon. This invention (Navy Case 103,028) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

The present invention relates to an integrated system of suppressing the noise and flash signature generated by firing a weapon. Existing systems suffer from a variety of design faults such as undesirable alteration of balance, inability to use in close quarters, and temperature induced failures or damage. Another disadvantage to current systems includes a noticeable difference in flash for a first shot taken through a suppressor. A first shot out of a suppressor at ambient temperature has a significantly greater light intensity than follow-on shots. Air within a suppressor is richer in oxygen during the first shot than during follow-on shots. The first shot effectively purges the suppressor of this oxygen-rich air. The oxygen contributes to the burning of more gun powder, which results in a greater flash signature. Yet another disadvantage of current systems is the possibility of baffle strikes, or bullet impacts to the interior of the suppressor. These impacts can result in fragmentation and bullets going astray from their intended target. Thermal management by current systems is another disadvantage. Existing suppressors can reach temperatures in excess of 1000° F. that can be attributed to design of a suppressor and its effect on entrapment of gas. Heat does not readily flow out of the suppressor through the suppressor muzzle. Another issue is point-of impact-shift with current suppressors. Since existing suppressors add weight at an end of the barrel due to their design, such suppressors will cause the barrel to flex and change the harmonics of the barrel. A weapon zeroed in one state, either suppressed or unsuppressed, will not be zeroed in the other state. Another disadvantage includes how, due to suppressors being mounted forward of the front sight, buoyant free convection associated with propellant gasses produce a plume of heated air as the suppressor heats up; this plume distorts the sight picture, effectively creating a condition known as mirage.

According to an illustrative embodiment of the present disclosure, a multi-chambered structure having a gas path through a barrel into an embodiment of the invention which routes propellant gas through multiple chambers having different functions (e.g., gas expansion/cooling, mechanical energy absorption, reduction of first shot flash, and balance/sighting improvement, and exit routing of gas at a terminal point of the gas path which prevents, e.g., sight picture suppression), as well as permitting use of existing barrel end attachments e.g., compensators, an additional suppressor (e.g., flash, etc.). Among other things, an embodiment of the invention eliminates passage of a bullet in direct proximity to baffles and reduces or eliminates other design disadvantages of existing systems.

According to a further illustrative embodiment of the present disclosure, unlike current suppressors, an embodiment of an Integral Multi-Chambered Valved Suppressor invention will keep the operating system of the weapon cleaner for a longer period of time. Gases in current suppressors have two paths to escape: out the suppressor muzzle and back down the barrel. Over time, particulates (carbon, lead, unburned gun powder, etc.) accumulate within the suppressor. Although some of these particulates exit with the bullet, some of them get cycled back with the gas required for the operation of the weapon (in the case of a semi-automatic or fully automatic weapon). The end result is a suppressed weapon is much dirtier than one unsuppressed. Although the invention provides suppression, it behaves more like an unsuppressed weapon in this manner.

According to a further illustrative embodiment of the present disclosure, another advantage of an exemplary Integral Multi-Chambered Valved Suppressor is the reduction in first shot flash. With an embodiment of the invention, oxygen may be purged from the suppressor due to incoming gases, but the timing of the event is such that most of the gunpowder has already ignited or dispersed prior to the oxygen exiting the suppressor.

According to a further illustrative embodiment of the present disclosure, an embodiment of an Integral Multi-Chambered Valved Suppressor invention offers a kinetic energy absorbing mechanism beyond current suppressors. Existing suppressors are made of rigid material. These rigid materials reduce the kinetic energy of the gas by interfering with its travel, effectively slowing it down. This loss in kinetic energy contributes to noise reduction. With one embodiment of the invention, section(s) of the suppressor structure are not entirely rigid. For example, one chamber, e.g., a baffle chamber, forming a segment of a gas path includes a cylindrical body with multiple baffle walls attached to the body in a substantially perpendicular orientation where the baffle walls form a barrier to the gas path. The baffle chamber, including the baffle walls, are covered with an elastomer cover stretched over the multiple baffle walls as well as a first and second end structures mounted on opposing ends of the cylindrical body where the first end structure is adapted to receive gas from a different segment of the gas path which flows on and the second end structure is adapted to exhaust gas from the gas path. Exemplary baffle walls (as well as end structures e.g., via shoulders or support ledges built into dividing walls) can provide a frame or support for the elastomer cover. The presence of this elastomer permits the absorption of more kinetic energy. The gas works on the elastomer to stretch it as the gas passes from chamber to chamber. Embodiments can include two or more chambers (e.g. gas expansion chamber and baffle energy absorption chamber) which are coupled end-to-end as well as formed in a U-shaped structure so as to create a gas path passing through multiple chambers which is U-shaped with, for example, a gas expansion chamber formed or disposed either inside of the baffle chamber floor or vice versa. An embodiment of the invention can include multiple flexible cylinder walls as well as having a metal section or deflection segment at a strike section of where exhaust gasses flow out of a barrel into an embodiment of the invention to address overpressure problems in proximity to barrel output into the invention.

According to a further illustrative embodiment of the present disclosure, an embodiment of the invention offers a method, mechanism, or structure by which to shift sound frequency. Some current suppressors claim to shift the sound frequency that emanates from the weapon. To do so, positioning of baffles becomes key to altering frequency. Since most current suppressors are welded together and cannot be taken apart, baffle spacing is fixed and sound can therefore be only shifted one direction. With the Integral Multi-Chambered Valved Suppressor, this shifting of sound frequency can be accomplished by, for example, varying a thickness of an elastomer along the length of the suppressor. Since the elastomer is replaceable, changing sound frequency, if desired, can easily be accomplished.

According to a further illustrative embodiment of the present disclosure, another advantage the Integral Multi-Chambered Valved Suppressor offers is that no additional length is added to the weapon. Existing suppressors extend beyond the muzzle to provide suppression. An embodiment of the invention is disposed around a barrel without extending beyond a barrel muzzle as well as, in some embodiments, beneath the handguard or rail system. An embodiment can also be designed to combine handguard/rail system elements structures with the suppressor as well.

Another illustrative embodiment of the present disclosure can include an embodiment which places a suppressor substantially or entirely beneath a hand guard or rail system. Accordingly, a center of mass stays close to the shooter thereby helping the shooter to maintain better weapon balance while firing.

Another embodiment can include a combination of a gas block inserted between two Integral Multi-Chambered Valved Suppressors which receives propellant gas from a barrel and passes it back to a loading/firing mechanism as well as multiple pass through structures which facilitate pass through of propellant gasses between multiple suppressors.

According to a further illustrative embodiment of the present disclosure, the invention does not preclude the use of a current flash hider and/or suppressor. An embodiment of an Integral Multi-Chambered Valved Suppressor is entirely rear of a muzzle. Accordingly, current flash hiders and/or suppressors can still be attached to a muzzle if so desired. The addition of a current flash hider and/or current suppressor could reduce flash and sound signature even more.

According to a further illustrative embodiment of the present disclosure, another advantage of the Integral Multi-Chambered Valved Suppressor is the ability to easily go from suppressed to unsuppressed with just a rotation of the suppressor portion in front of the gas block. This rotation could also be used to effectively block off the rear portion of the suppressor to obtain a suppressed, yet louder gun fire. Alternatively, in another embodiment of the invention, it would block off access to the cooling function of the suppressor, which may be desired if the cooling fluid has been depleted. The invention eliminates point-of-impact shifts associated with removable suppressors. Removable suppressors add weight at the end of the barrel, which causes the barrel to flex and changes the harmonics of the barrel. The suppressor must be taken on and off every time the operator goes from suppressed to unsuppressed. The proposed invention can be switched from suppressed to unsuppressed without changing the weight or harmonics of the barrel, thereby eliminating point-of-impact shifts.

According to a further illustrative embodiment of the present disclosure, unlike most current suppressors that are sealed units, this invention has the potential to allow removal, disassembly, and cleaning by the operator. The ability to easily clean the invention allows the removal of residue; residue reduces suppression effectiveness and increases weight, which affects point-of-impact.

According to a further illustrative embodiment of the present disclosure, another advantage offered by the invention is the drastic reduction, possibly even elimination, of the phenomenon known as mirage. Since the suppressor is contained beneath the handguard, there is no heated plume forward of the weapon sight that would distort the sight picture.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1A:
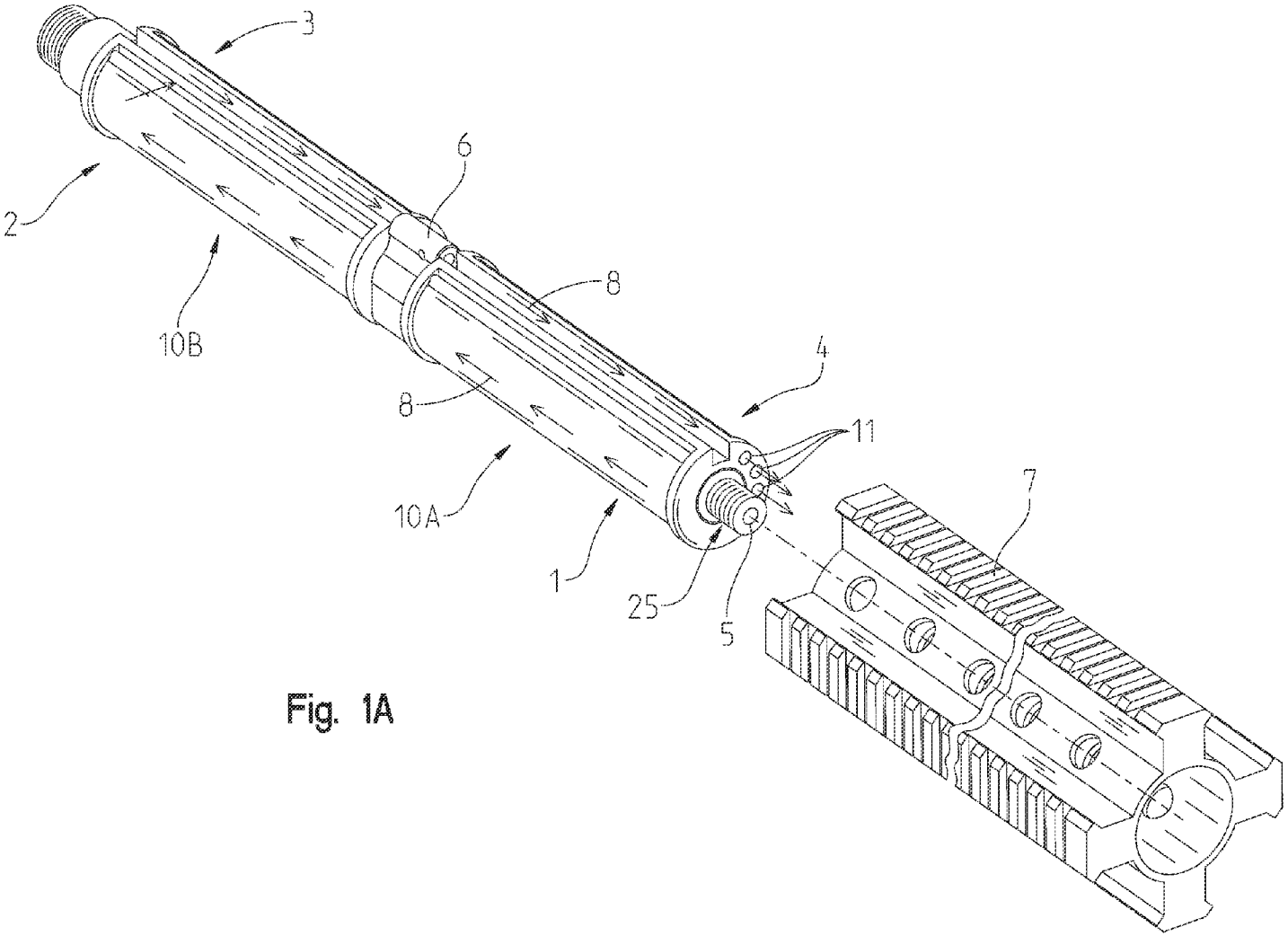
FIG. 1A shows a simplified partially exploded perspective diagram of one embodiment of an integral multi-chambered valved suppressor with rifle barrel inserted and an accessory mounting rail system/hand grip.

Referring initially to FIG. 1A, a partially exploded diagram of an exemplary integral multi-chambered valved suppressor assembly is shown. In this embodiment, an external view of the exemplary integral multi-chambered valved suppressor system is shown disposed around a rifle barrel 25 except for a rear and forward segment of a rifle barrel 25. The exemplary suppressor system comprises two suppressor assembly portions: Forward Multi-Chamber Suppressor Assembly (hereinafter Forward Assembly) 10A and a Rear Multi-Chamber Suppressor Assembly 10B (hereinafter Rear Assembly 10B) are disposed on opposing sides of the PTMPGB 6. The exemplary barrel 25, Forward Assembly 10A, PTMPGB 6, and Rear Assembly 10B are adapted to create a Suppressed Gas Path 8 through multiple chamber structures comprising baffle structure/elastomer cover operative combination structures and pass thru passages, with an output section through gas path exhaust ports 11 formed in an end section of the Forward Assembly 10A in proximity to the muzzle 5 section that exhausts gas path 8 gas from Forward LH Chamber 4 in an orientation which reduces interference with sighting mechanisms of the gas operated assembly (e.g., automatic or semi-automatic rifle). The displayed exemplary Forward Assembly 10A comprises Forward RH Chamber (e.g., multi-chamber/valved baffle section) 1 (internal structure not visible) and a Forward LH Chamber (e.g., multi-chamber/valved baffle section) 4 (not visible). The Rear Assembly (e.g., multi-chamber/valved assembly) 10B comprises a Rear RH Chamber (e.g., multi-chamber/valved baffle section) 2 (internal structure not visible) and a Rear LH Chamber (e.g., a multi-chamber/valved baffle section) 3 (not visible). See, e.g., FIG. 1B for more details on internal structures of the exemplary Forward and Rear Assemblies 10A/10B. The exemplary Forward Assembly 10A can be coupled with one side of the PTMPGB 6 and the Rear Assembly 10B can be coupled to an opposing side of the PTMPGB 6 such that the PTMPGB 6 is formed with a first and second gas path through structures (not shown but e.g., see FIG. 1B, 6B path; also see FIG. 1C, 26A port; See also, FIG. 4 73A/73B, for other possible examples) adapted to enable gas output from a gas output port in a projectile barrel section (not shown), e.g. near muzzle 5, into the Forward RH Chamber 1 to pass between the Forward RH Chamber 1 into the rear RH baffle chamber section and for gas to pass from the Rear LH Chamber 3 into the Forward LH Chamber 4. Each of the exemplary Chamber sections 1, 2, 3, and 4 are further formed and enclosed by exemplary Elastic Membrane Covers 21A-21D (See e.g., FIG. 1B, elastic membrane covers over each chambers 1, 2, 3, and 4), which form respectively external walls for each of the Chambers 1, 2, 3, and 4 in order to define in part Suppressed Gas Path 8.

An exemplary FIG. 1A-1D Elastomer Coverstop/Accessory Mount (CSAM) (e.g., accessory rail attachment structure) 7 is also provided which is disposed and mounted/fixed over the suppressor assembly that includes Forward Assembly 10A, PTMPGB 6, and Rear Chamber 10B. The FIGS. 1A-1D suppressor assembly embodiment can further be disposed over the barrel 25 while permitting the barrel 25 muzzle 5 to extend from the CSAM 7. An exemplary CSAM 7 can further be adapted to be used as a hand grip structure for a user of a gas projectile system equipped with an exemplary embodiment of the invention. An exemplary hand grip structure formed as a part of the CSAM 7 can further include heat vent holes between accessory mounting rails adapted to increase air circulation around various chambers, e.g., 1, 2, 3, and 4, as well as an exemplary heat management/reflection/venting system (not shown) that could include metal heat shields segments disposed between the exemplary cover stop/mount structure and one or more of the various Chambers 1, 2, 3, 4 as well as an exemplary PTMPGB 6. The exemplary heat management structure could include a structure adapted to permit air to be passed by upward heat convention from the barrel 25 and/or the Forward and Rear Assemblies 10A/10B from a lower section of the hand grip structure to venting apertures in the hand grip structure making up a part of the CSAM structure 7. The exemplary CSAM 7 can be coupled with various points of a gas projectile assembly including a receiver assembly (not shown) which couples with the barrel 25, the Forward and Rear Assemblies 10A/10B, the PTMPGB 6, and/or via another mounting structure (e.g., one or more set screws) adapted to maintain the CSAM 7 in relatively fixed orientation to an exemplary suppressor structure/barrel structure 25 (e.g., spring loaded collar on one or both ends that engages edge sections of a suppressor assembly and/or the CSAM 7). The exemplary CSAM 7 can be adapted to provide a displacement space or area and movement stop for the elastic membrane covers, e.g., 21A-21D, in this embodiment to prevent excessive expansion/travel of the elastic membrane covers 21A-21D caused by gas passing through the Chamber sections 1, 2, 3, and/or 4.

As noted herein, different Elastomer Covers 21A-D can be substituted in order to provide different suppression effects such as altering frequency of sound emissions from the exemplary multi-chamber/valved suppressor as well as providing other functions such as gas force absorption via controlled gas passage/expansion along the Suppressed Gas Path 8. In one embodiment, Elastomer Covers 21A-D can comprise a silicon based elastomer. Another embodiment of the invention can be adapted to use non-Elastomer Cover(s) which eliminate or reduce expansion and travel or movement of the covers as gas passes through the baffle chambers to facilitate suppression by other suppression structures (e.g., flaps or deflection barriers (not shown) within the exemplary baffle chamber sections 1, 2, 3, 4 or other suppression path structures (e.g., see FIG. 2)). An external section(s) of accessory mount 7 can be formed with rail structures including multiple extensions each having notch structures and a rail type form adapted to couple with accessories such as sights, laser pointers, or other firing/guidance/systems, e.g., lights, thermal imagers, etc. Exemplary gas path exhaust ports 11 can be disposed in a multi-chamber assembly, e.g., Forward Assembly 10A, such that exhaust gas is expelled away from a sight mechanism, e.g., though an end wall section of the Forward Assembly 10A or an end cap (e.g., see FIG. 3, 63), so as to prevent exhaust gas from interfering with, e.g., weapon sights, accessories mounting on the accessory mount 7, or other structures which can be impacted by exhaust gas. Gas Path Exhaust Ports 11 can also be formed to provide a desired force on a barrel 25 such as a firing compensator adapted to push the barrel 25 in a desired direction e.g., down. An exemplary PTMPGB 6 can be adapted to couple with a gas tube (not shown) which can be routed through a Gas Tube Channel (See FIG. 1B, 31) which couples with a gas powered system, e.g., rifle receiver in a projectile firing system, that receives projectile gas output from the barrel 25 into the PTMGB 6 via a gas block gas input port (not shown) through the barrel 25. An exemplary integral multi-chambered valved suppressor assembly can also be formed to rotate around the barrel 25 in whole or in part, e.g., only the Forward Assembly 10A, in order to adjust or cut-off gas routed into the suppressor assembly so the exemplary suppressor gas output port in the projectile barrel section (not shown), e.g., near muzzle 5, is cut off from communicating projectile gas from inside the barrel 25 into the Forward RH Chamber 1 (e.g., multi-chamber/valved baffle section). An exemplary embodiment can have a Rotational Coupler 6A or equivalent rotational connecting structure that attaches the Forward Assembly 10A with the PTMPGB 6 to perform the rotational coupling effect or benefit so as to enable closing off gas routed into the suppressor assembly, e.g., Forward Assembly 10A, via rotation or other (e.g., lateral) movement. An alternative embodiment can also include other mechanisms to cut off gas inputs from the barrel 25 into the Forward RH Chamber 1 or other sections of the Forward Assembly 10A or Rear Assembly 10B or even the PTMPGB 6. In this exemplary embodiment, the combined apparatus of Forward and Rear Assemblies 10A/10B and PTMPGB 6 can be entirely or substantially contained or enclosed beneath the CSAM 7.

Figure 1B:
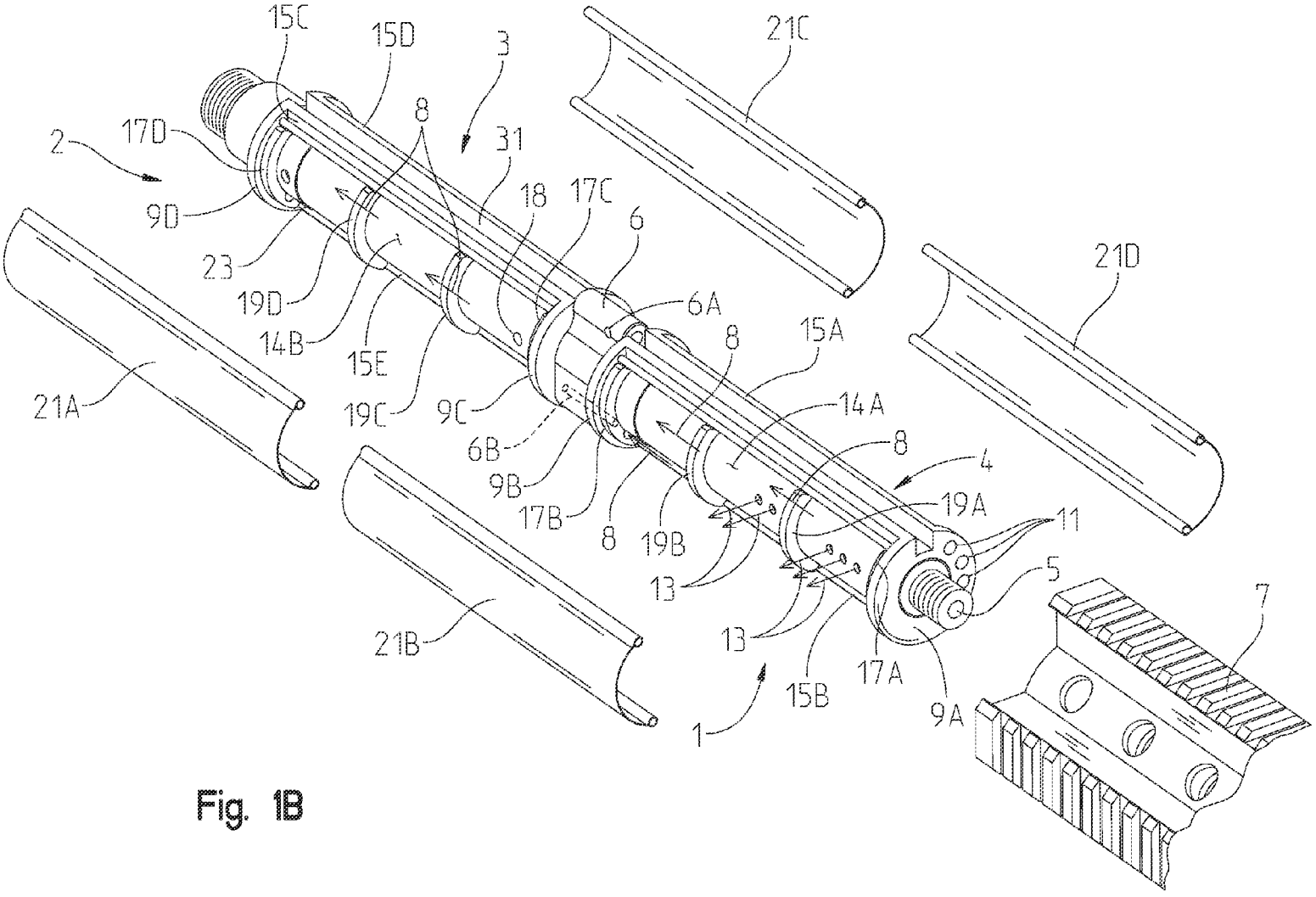
FIG. 1B shows a simplified exploded right hand (RH) perspective view (from a shooter's perspective) of an exemplary embodiment of multiple multi-chamber suppressor chambers assemblies on opposing ends of a Pass Through Multi-Passage Gas Block (PTMPGB) with one example of an accessory mounting rail system/hand grip.

Referring to FIG. 1B, an exploded view of aspects of the invention is shown including a simplified depiction of how the exemplary FIG. 1A-1D suppressor system interacts with the PTMPGB 6 along the Suppressed Gas Path 8. The Forward Assembly 10A includes a First Cylindrical Inner Wall Floor Structure 14A which forms an inner side of the Forward Assembly 10A. The Forward Assembly 10A further is formed to include circular or semi-circular End Walls 9A and 9B which are respectively disposed and formed on opposing ends of the Cylindrical Inner Wall Floor Structure 14A so as to extend away from one side face of the First Cylindrical Inner Wall Floor Structure 14A. The exemplary End Walls 9A/9B are further formed with cover wall shoulders 17A, 17C (not visible) and are adapted with a physical mating surface or shelf/shoulder for mating, contact, or close proximity with end edge section of Elastomer Membrane Cover 21A. The Forward Assembly 10A is further formed with a Top Wall 15A and a Lower Wall 15B which are respectively formed on opposing sides of the Forward Assembly 10A and define additional wall sections enclosing or surrounding the first Cylindrical Inner Wall Floor Structure 14A. A combination of Top Wall 15A, Lower Wall 15B, End Walls 9A/9B and the Elastomer Membrane Cover 21A collectively create an outer envelope, enclosure, or partial container area for a segment of the Suppressed Gas Path 8 which is further divided by semi-circular, e.g., "C" shaped, solid or flexible baffle structures (e.g., baffle structures 19A, 19B) perpendicularly coupled to and extending away from spaced apart sections of the Cylindrical Inner Wall Floor Structure 14A of the RH Chamber 1 side of the Forward Assembly 10A. The Forward LH Chamber 4 side of the Forward Assembly 10A is substantially formed with the same or similar structures as on the Forward RH Chamber 1 side of the Forward Assembly 10A. The exemplary Elastomer (or elastic) Membrane Cover 21A is disposed and coupled with the Forward Assembly 10A, e.g., by rods (e.g., see FIG. 1C, 27) coupling opposing longitudinal sides of the Elastomer Membrane Cover 21A such that the Cover 21A is disposed and fixed in substantial contact or close proximity to cover wall shoulders 17A-17D formed into Top Wall 15A, Lower Wall 15B, and End Walls 9A/9B. Elastic Membrane Cover 21A therefore fits into a recessed ledge formed into Top Wall 15A, Lower Wall 15B, End Walls 9A/9B by the shoulders 17A-17D, is stretched or placed over a chamber space defined by the Top Wall 15A, Lower Wall 15B, End Walls 9A/9B, and is in contact or close proximity with Baffle Structures 19A, 19B. The Elastomer Membrane Covers 21A-21D can also be replaced with one or more socks, stretchable containing structures, balloon-type structures or cylindrical cover structures (not shown) so as to form a displaceable or flexible barrier on a side opposing the First Cylindrical Inner Wall Floor Structure 14A which rest on or is in close proximity to sections of the Walls and Baffle structures. An alternate embodiment of Covers, e.g., 21A-21D, can also be non-flexible, relying upon flexible baffle structures which displace when gas is introduced along the Suppressed Gas Path 8. Another embodiment can form Cylindrical Inner Wall Floors (e.g., First Cylindrical Inner Wall Floor Structure 14A) with a flexible material in whole or part to permit one or both of the Elastic Membranes (e.g., 21A) and/or the Floor (e.g., 14A) to flex or displace when gas enters various Chambers, e.g., the Forward RH Chamber 1. In the FIG. 1B embodiment, Elastomer Membrane Cover 21A can be disposed to form an outer wall section on an outer side of a Forward Assembly 10A to enclose gas passing through chambers including the Forward RH Chamber 1 along a segment of the Suppressed Gas Path 8. Baffle structures can also be formed as a variety of structures adapted to absorb mechanical or other types of energy (as well as facilitate expansion of gas into one or more Chambers to permit cooling or other suppression functions) along the Suppressed Gas Path 8 to perform one or more suppressor functions.

The Forward Assembly 10A is shown with its own Elastomer Covers 21A, 21D over a RH and LH side of the Forward Assembly 10A, respectively. The Rear Assembly 10B is also shown with its own Elastomer Covers 21B, 21C over RH and LH sides of the Rear Assembly 10B, respectively. The Elastomer Covers 21A-21D rest upon cover shoulders, e.g., Cover Wall Shoulders 17A-17D associated with the Forward RH Chamber 1 of Forward Assembly 10A and formed by extrusions, shelves/shoulders, or walls extending up from and enclosing First Cylindrical Inner Wall Floor Structure 14A. In this embodiment, Rear Assembly 10B's Rear RH Chamber 2 and Rear LH Chamber 3 and Forward Assembly 10A's Forward LH Chamber 4 are formed with Wall structures substantially equivalent to Walls 15A, 15B, 9A/9B with cover mating shoulders 17A, 17B, 17C (not visible in this embodiment but part of End Wall 9A), and 17D.

Along a gas path defined by a rifle passage inside the barrel 25, projectile gas is received by the exemplary PTMPGB 6 first and then by the gas output passage and port through a side of the projectile barrel 25 (not shown), e.g., near muzzle 5, that is adapted to expel projectile gas into the Forward RH Chamber 1 (e.g., multi-chamber/valved baffle section). An alternative embodiment of one or more of the Chambers 1-4 can also be adapted so as to permit some of the exiting gases to escape but ensuring a substantial majority of exiting projectile gasses are routed or sent back, e.g., through the gas tube (not shown), to a gas powered section(s) of a gas powered firearm, e.g., self-loading sections, including a gas powered bolt and cartridge ejection/loading section. The CSAM 7 is shown removed along a CSAM lateral removal path from the suppressor Forward and Rear Assemblies 10A/10B, PTMPGB 6, and barrel 25.

The exemplary Rear Assembly 10B can be formed with similar structures as the Forward Assembly 10A with some differences. For example, an exemplary Rear Assembly 10B can be formed with a Second Cylindrical Inner Wall Floor Structure 14B with End Walls 9C/9D formed on opposing ends of and extending away from the Second Cylindrical Inner Wall Floor Structure 14B. The Rear Assembly 10B further can include a Rear RH Top Wall 15C, a Rear LH Top Wall 15D, and a Rear Lower Wall 15E, where the Rear Top Walls 15C, 15D are formed on an opposing side of the Second Cylindrical Inner Wall Floor Structure 14B from the Rear Lower Wall 15E. The lateral ends of Rear Top Walls 15C, 15D and Rear Lower Wall 15E can be formed to couple with End Walls 9C, 9D so as to form side walls and thus partially enclose a space defined by these Walls and Floor structures. Walls 15C, 15D, and 15E and End Walls 9C, 9D can be formed with shoulders or ledges adapted to mate or be in close proximity to the Second Elastic Membrane Covers 21B, 21C. The Rear RH Top Wall 15C and Rear LH Top Wall 15D can be spaced apart to form a Gas Tube Channel 31 which permits a gas tube to be disposed therein and coupled on one end with the PTMPGB 6 to communicate gasses from the PTMPGB6 back to the gas powered section(s) of a gas powered system such as described herein.

In FIG. 1B, Suppressed Gas Path 8 passes through Forward RH Chamber 1, Rear RH Chamber 2, Rear LH Chamber 3, and Forward LH Chamber 4 in sequence, wherein the Suppressed Gas Path 8 passes over a variety of baffle structures, e.g., a first set of Baffle Structures 19A, 19B within Forward RH Chamber 1 and a second set of Baffle Structures 19C, 19D within Rear RH Chamber 2, as well as through the PTMPGB 6. One segment of the Suppressed Gas Path 8 is through gas output port(s) (not shown) in the projectile barrel 25 that is coupled or communicates with Gas Path Entry Ports 13 formed in the first section of Cylindrical Inner Wall Floor Structure 14A where the First Cylindrical Inner Wall Floor Structure 14A forms one side of the Forward RH Chamber 1. The Gas Path Entry Port(s) 13 receive projectile gas from the barrel 25 through one or more gas passages or paths formed in the barrel 25 (not shown). A section of the suppressor assembly, e.g., Forward Assembly 10A, can be formed or adapted to provide a blocking or sealing structure to the gas paths formed in the barrel 25 (not shown) so that when the suppressor assembly, e.g., Forward Assembly 10A, is moved or rotated (e.g., via Rotational Structure 6A), the gas paths or passages formed in the barrel 25 are blocked from outputting projectile exhaust gas into the Forward RH Chamber 1. Baffle Structures, e.g., 19A, 19B, are disposed within the Forward RH Chamber 1 and can be formed from flexible or solid material which is resistant to exhaust gas pressure and/or temperature so as to displace (or permit the Elastomer/Elastic Cover 21A to displace or a combination thereof) when exhaust gas travels the first segment of the Suppressed Gas Path 8. Such displacement by Baffle Structures, e.g., 19A, 19B, absorbs energy from the exhaust gas input from Gas Path Entry Ports 13 through a mechanical absorption and/or expansion effect such as deflection (e.g., a burping motion formed by displacement of a portion of the baffle structure 19A, 19B, etc. so as to permit gas to pass between an outer edge of the baffle structure and elastic membrane cover 21 as a part of the Suppressed Gas Path 8) or expansion of gas into various Chambers. The Suppressed Gas Path 8 can be further defined by a First Gas Pass Thru Path Port(s) 6B formed in relation to Forward and Rear Assemblies10A/10B and the PTMPGB 6 to permit gas to pass between the Assemblies 10A/10B (e.g., from the Forward RH Chamber 1 of the Forward Assembly 10A past or through a RH side of PTMPGB 6, e.g., via 6B passage, and into Rear RH Chamber 2 of the Rear Assembly 10B). Another Gas Pass Thru Port (not shown) can be formed on an opposing LH side of the Front and Rear Assemblies10A/10B and LH side of PTMPGB 6 to permit gas to pass between Rear LH Chamber 3 and Forward LH Chamber 4. Another gas pass through passage, Rear Gas Pass Thru 23, can be formed into a rear section of the Rear Assembly 10B to permit gas to pass from Rear RH Chamber 2 to Rear LH Chamber 3. A coupling mechanism, e.g., set screw 18 can be inserted through the Second Cylindrical Inner Wall Floor 14B of the Rear Assembly 10B to apply pressure against the barrel 25 inserted within the Rear Assembly 10B and thereby prevent the Rear Assembly from moving in relation to the barrel 25. Additional baffle structures and gas pass through ports can be disposed in relation to and/or within the structures defining Rear LH Chamber 3 (not visible) of Rear Assembly 10B and structures defining the Forward LH Chamber 4 (not visible) of Forward Assembly 10A with similar structures such as described with respect to Forward RH Chamber 1 and Rear RH Chamber 2 which define baffle/valve/expansion spaces and are adapted to mate with Elastomer/Elastic Membrane Covers 21C and 21D. For example, see FIGS. 1C and 1D.

In exemplary embodiments (e.g., FIGS. 1A-1D embodiments), baffles (e.g., Baffles 19A-19D) can be disposed within various chambers (e.g., Forward RH Chamber 1, Rear RH Chamber 2, etc.) to subdivide the chambers into a number of chambers or sub-chambers. In this example, as pressure from the gases builds, input gas "burps" or expands into and between the sub-chambers by expanding various aspects of the Forward and/or Rear Assemblies 10A/10B (e.g., Elastic Cover 21A-21D, a flexible/elastic membrane(s) stretched over the baffles), by means of movement of flexible baffles, or by a combination of expanding various aspects of the Forward and/or Rear Assemblies 10A/10B and movement of flexible baffles. Some of the suppressed gas or moving gas in a gas powered mechanism can also be recirculated or routed back into the system. For example, suppressed gas or moving gas in a projectile or gas powered system, e.g., a firearm, can be routed through the PTMPGB 6 (or other structure) into a gas tube (not shown) and back into the system to cycle the system.

Figure 1C:
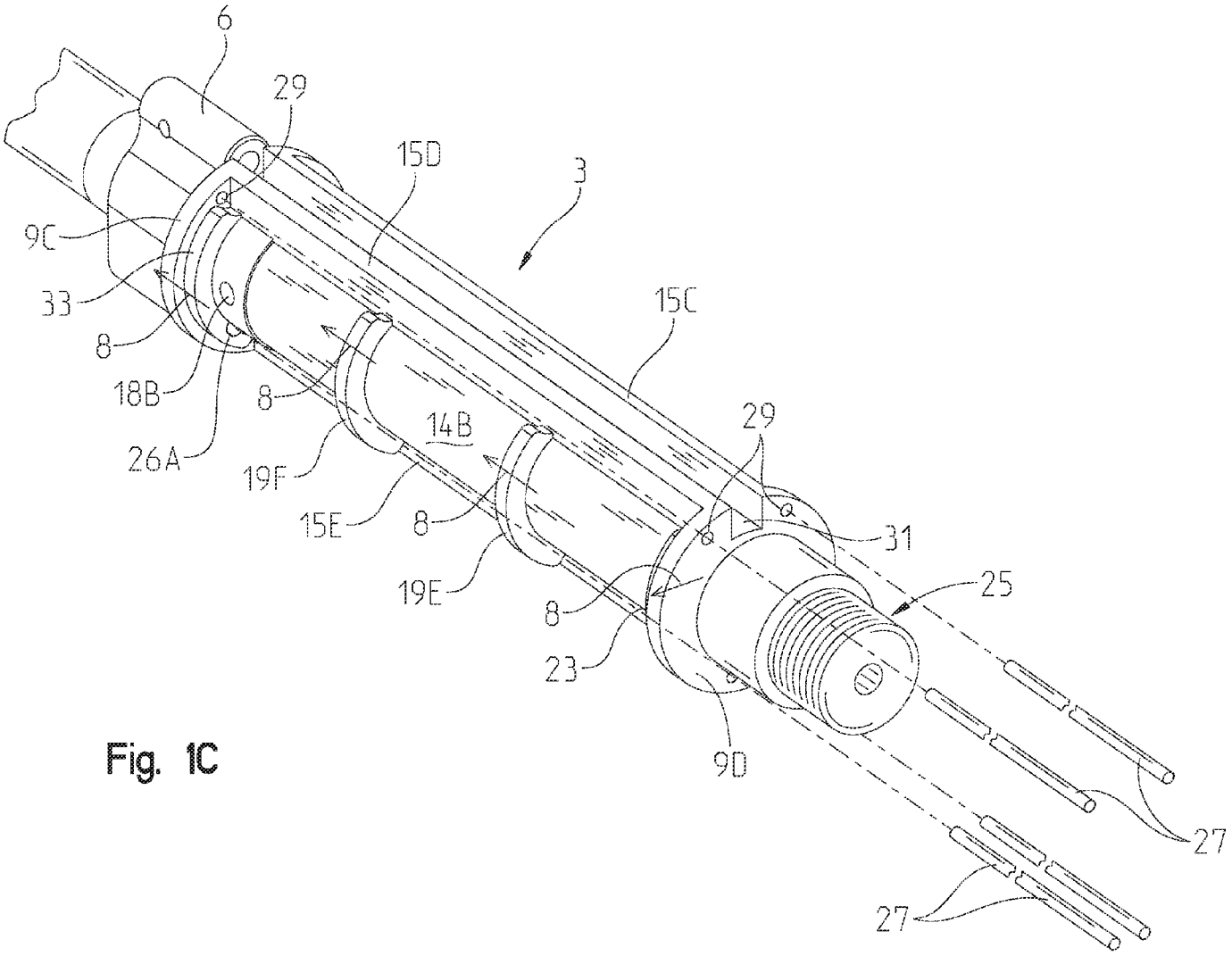
FIG. 1C shows a simplified exploded rear left hand (LH) perspective view of a rear LH chamber section of an exemplary embodiment of the invention.

FIG. 1C shows a perspective view of a partially exploded exemplary Rear Assembly 10B with a view of an exemplary Rear LH Chamber 3 with baffles disposed therein showing a segment of Suppressed Gas Path 8 with Elastic or Elastomer Cover 21C removed. A set screw 18B is provided through the Second Cylindrical Inner Wall Floor Structure 14B to limit or prevent relative movement between the Rear Assembly 10B and barrel 25. Rear Assembly 10B End Walls 9C/9D are disposed or coupled substantially perpendicularly to and away at opposing ends of the Second Cylindrical Inner Wall Floor Structure 14B to enclose portions of an envelope of space associated with the Rear LH Chamber 3 similar to the Rear RH Chamber 2's Walls (9C/9D, 15C, 15E) and Floor Structure 14B structures. Rear LH Top Wall 15D and Rear Lower Wall 15E are disposed on substantially or approximately opposing sides of the Second Cylindrical Inner Wall Floor Structure 14B (e.g., top and bottom). Opposing ends of the Rear Lower Wall 15E and Rear LH Top Wall 15D are connected to End Walls 9C/9D to enclose a space bounded on one side by the Second Cylindrical Inner Wall Floor Structure 14B and on an opposing side by Elastic or Elastomer Cover 21C (not shown). Baffle Structures 19E, 19F are disposed within the Rear LH Chamber 3 to provide sub-chambers or sections which operate in conjunction with Elastic or Elastomer Cover 21C (not shown) to produce a suppression/absorption and/or expansion result/effect with respect to the Suppressed Gas Path 8 when gas passes over or in relation to the Baffle Structures 19E, 19F by deflection of Elastic or Elastomer Cover 21C and/or Baffle Structures 19E, 19F. A Gas Pass Thru Port or Passage 26A is provided through End Wall 9C to pass gas into or by PTMPGB 6 into the Forward LH Chamber 4 via a similar port in End Wall 9B of the Forward LH Chamber 4, e.g., Gas Pass Thru Port 26B. In this example, support shoulders, e.g. Support Shoulder 33, are provided in End Walls 9C/9D as well as Rear LH Top Wall 15D and Rear Lower Wall 15E that are adapted to provide a recessed mating ledge or shoulder to receive Elastic or Elastomer Cover 21C. Alternate embodiments can provide no or fewer shoulders or ledge mating structures (e.g., having Cover 21C disposed in substantially close proximity or sealingly to a Wall, e.g., Rear LH Top Wall 15D, without a shoulder or ledge but yet providing a substantial or partial gas seal adequate to ensure desired functionality of an embodiment of the invention). A Gas Tube Channel 31 can be formed by spaced apart Rear LH Top Wall 15D and Rear RH Top Wall 15C disposed on top of Rear Assembly 10B (or in another position and/or orientation suitable to route a gas tube to the gas powered system). Elastic or Elastomer Cover 21C attachment rods 27 can be provided, in this embodiment, which pass through End Walls via apertures, e.g., 29, to attach and couple sides of Elastomer Covers 21B and 21C. Other Cover attachment or coupling structures are also possible in alternative embodiments to include mechanical coupling structures as well as adhesive forms or means.

Figure 1D:
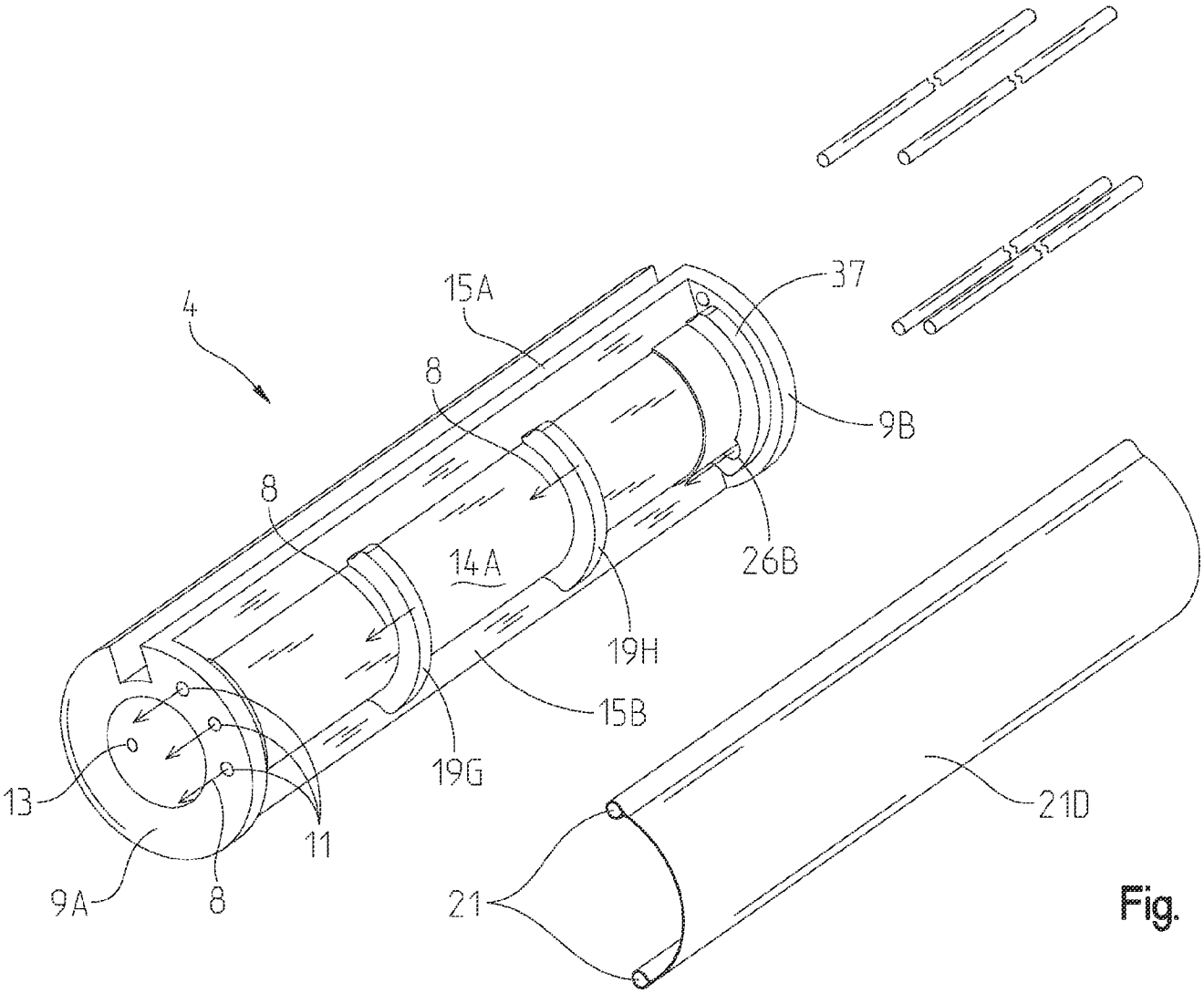
FIG. 1D shows a simplified exploded forward LH perspective view of a forward RH chamber section of an exemplary embodiment of the invention.

Referring to FIG. 1D, an exemplary Forward LH Chamber 4 is bounded on one side by a portion of the First Cylindrical Inner Wall Floor Structure 14A, on an opposing side by an Elastic or Elastomer Cover 21D (removed), by End Walls 9A/9B on longitudinal ends of the First Cylindrical Inner Wall Floor Structure 14A, and by Forward Top Wall 15A/Forward Bottom Wall 15B on sides of First Cylindrical Inner Wall Floor Structure 14A. Baffle Structures 19G, 19H are disposed within the Forward LH Chamber 4, spaced apart and attached to the First Cylindrical Inner Wall Floor Structure 14A on one edge and to the Forward Top and Bottom Walls 15A/15B on the Baffle Ends. The Baffles 19G, 19H are formed to conform to the First Cylindrical Inner Wall Floor Structure 14A as well as have a matching contour with the End Walls 15A, 15B so as to facilitate the Elastomer or Elastic Cover 21D mating with Walls 15A, 15B, 9A, and 9B as well as an outer edge of the Baffle Structures 19G, 19H. Exemplary Exhaust Ports 11 are formed through End Wall 9A to permit gas to pass out of the Forward LH Chamber 4 as an exit and end point of the Suppressed Gas Path 8. Exhaust ports could also, for example, be formed through a circumferential wall, e.g., Elastomer Cover 21D, of the Forward LH Chamber 4. In the exemplary embodiment in FIG. 4, rods are used to secure Cover 21D to mate with wall-to-cover mating structures, e.g., Shoulders 37 that are formed into upper sections of the Walls 9A/9B and 15A/15B to fit with Cover 21D over Forward LH Chamber 4. FIG. 1D shows an aperture surrounded and defined by the First Cylindrical Inner Wall Floor Structure 14A and inner circumferential edge of End Wall 9A that is formed to transition into the First Cylindrical Inner Wall Floor Structure 14A which barrel 25 inserts into. In one embodiment, a similar aperture is defined by Inner Wall Floor Structure 14B as is defined by Inner Wall Floor Structure 14A. The apertures formed by Inner Wall Floor Structure 14A/14B can constitute a single aperture through the entire length of the exemplary integral multi-chambered valved suppressor assembly and can be unobstructed. FIG. 1D also shows Gas Path Input Port 13 entry point that aligns with a passage through barrel 25 to permit projectile or other gas to enter into Forward RH Chamber 1.

Figure 2:
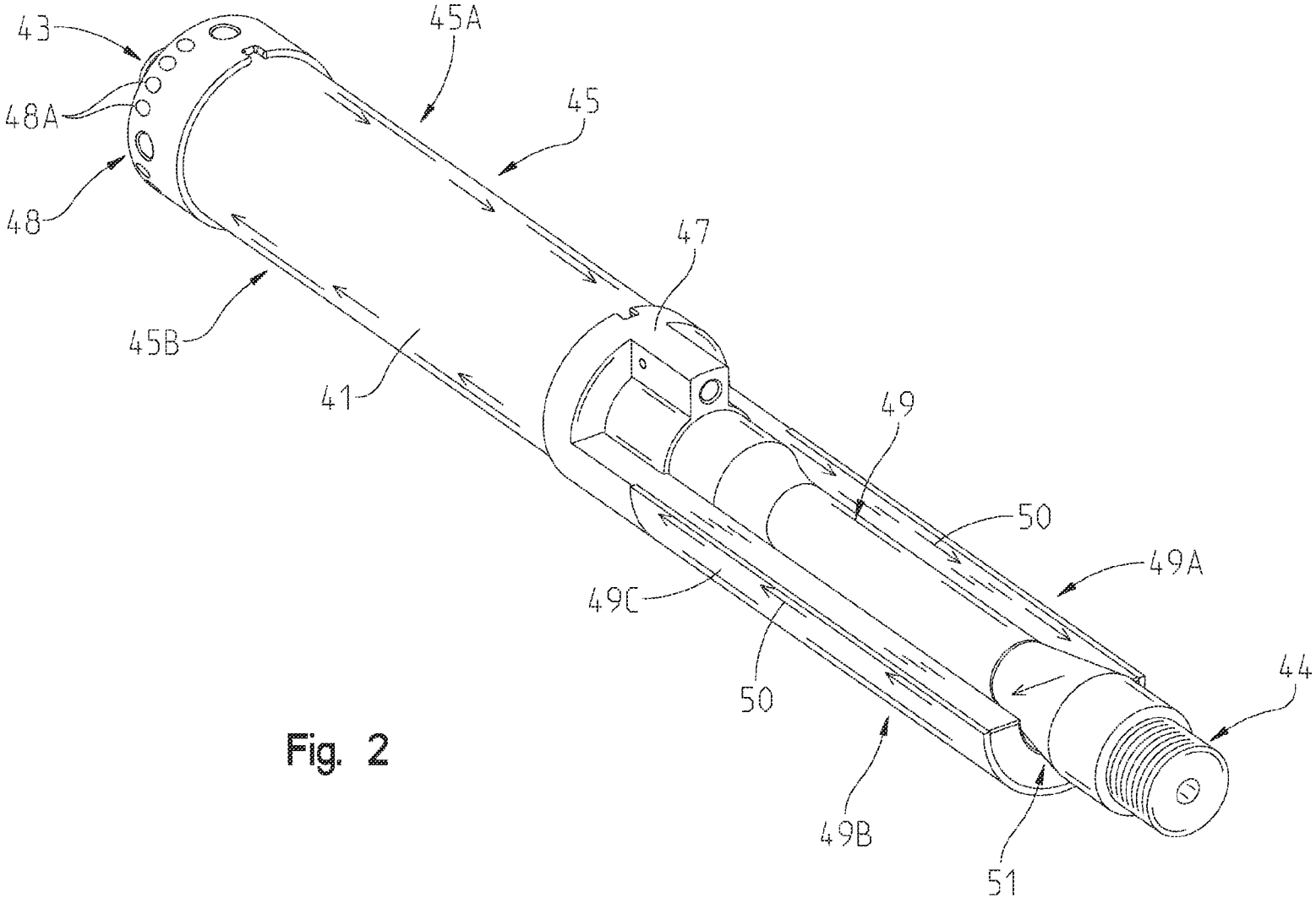
FIG. 2 shows another embodiment of an exemplary embodiment of a multi-chambered valved suppressor invention with at least some chambers with different structure(s) than FIGS. 1A-1D (e.g., exemplary baffle chambers and expansion chambers)

Referring to FIG. 2, another embodiment of the multi-chamber/valved invention in an assembled perspective view form is shown with some differences from the embodiment in FIG. 1A-1D. A Forward Assembly 45 with LH 45B and RH 45A Baffle Chambers including a one piece cylindrical Baffle Chamber Cover 41, End Cap 48 with Exhaust Ports 48A, and Baffle Structures (not visible) are provided. A PTMPGB 47 is provided and coupled on one side to the Forward Assembly 45 and on an opposing side to a Rear Assembly 49. The Rear Assembly 49 includes a Rear RH Expansion Chamber (not visible) 49A and a Rear LH Expansion Chamber 49B (not visible) which are coupled on a rear section of the Rear Assembly 49 by an Expansion Chamber Gas Pass Thru Passage 51 (not visible). In this embodiment, the Expansion Chambers 49A, 49B are formed in a half circle structure that is formed to position under and partially surrounding the bottom up to half of the sides of the Barrel 44. An Expansion Chamber Cover 49C is provided which covers internal structures which define and surround all but one side of a space defined by the Rear RH and LH Expansion Chambers 49A, 49B. A Suppressed Gas Path 50 passes into the Forward RH Baffle Chamber 49A by a gas passage (not visible) that communicates with a passage through Barrel 44 adapted to receive projectile gas through the Barrel 44. Suppressed Gas Path 50 then passes between Baffle Structures and Cover 41, through a passage in relation to PTMPGB 47 into the Rear RH Expansion Chamber 49A, through Expansion Chamber Gas Pass Thru Passage 51 into Rear LH Expansion Chamber 49B, through a gas passage (not visible) that communicates Suppressed Gas Path 50 into the Front LH Baffle Chamber 45B, and through exhaust ports 48A in the end Cap 48, where the exhaust ports 48A are on a circumferential side of the End Cap so as to direct exhaust gasses laterally rather than upwardly in order to avoid interference with a forward sighting mechanism used in relation to the gas powered structure the invention is coupled to.

Figure 3:
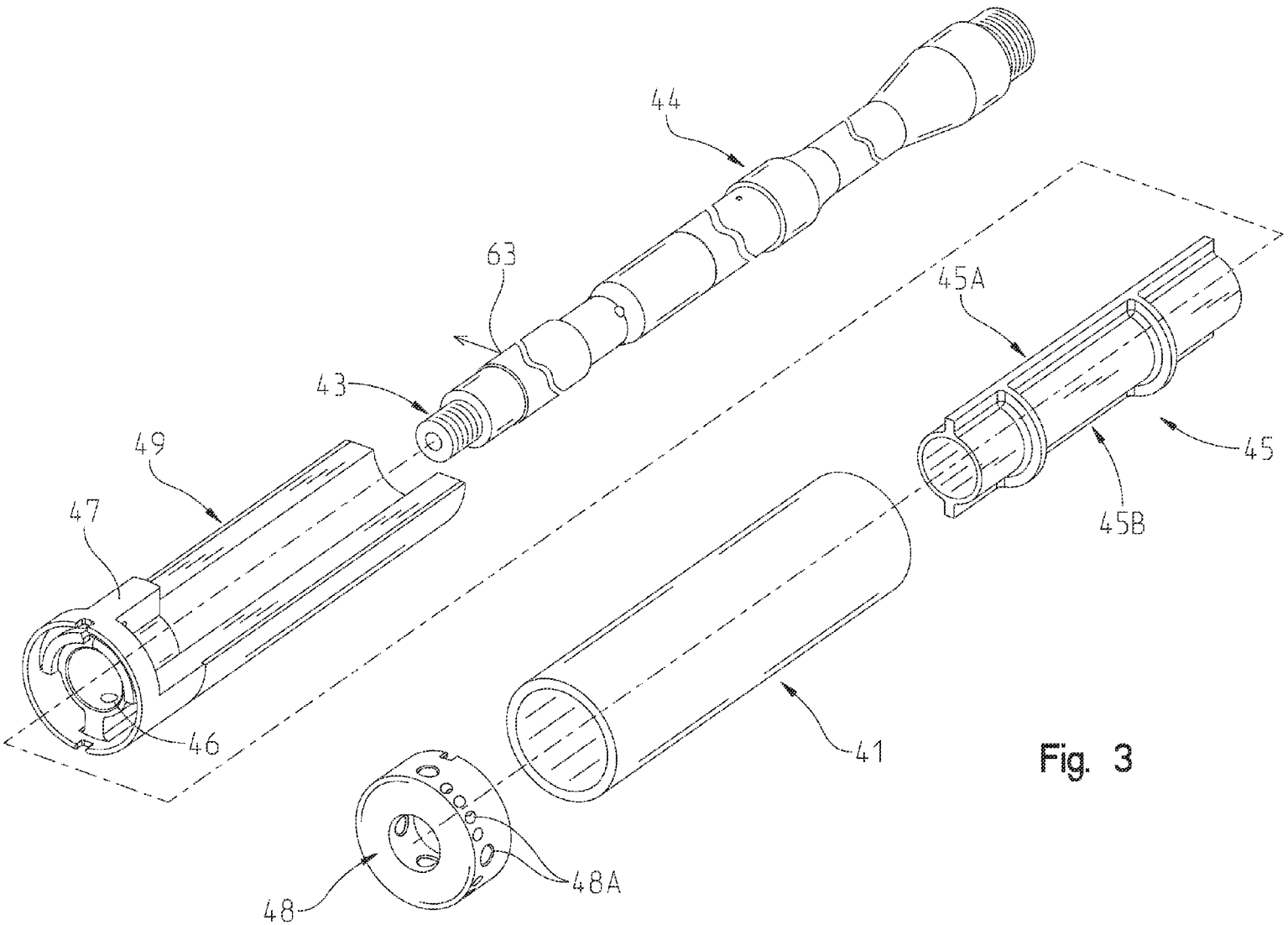
FIG. 3 shows an exploded diagram of the FIG. 2 exemplary embodiment of the invention including a baffle chamber assembly, an expansion chamber assembly, and a barrel.

FIG. 3 shows a partially exploded view of the FIG. 2 assembly where the Forward Assembly 45, Rear Assembly 49, PTMPGB 47, and barrel 44 are shown. A location of an exemplary barrel gas output port 63 is shown; however, alternative embodiments can locate this port in another location provided it does not interfere with PTMPGB 47 function. A set screw 46 is shown in relation to the PTMPGB 47 interior which fixes the PTMPGB 47 in relation to the barrel 44. The PTMPGB 47 in this embodiment is substantially the same as the embodiments described in relation to FIGS. 1A-1D to include use of a gas tube to communicate gas to a gas operated system the invention is coupled to. Forward Chamber Cover 41 is also shown covering LH and RH Baffle chambers 45A, 45B of the Forward Assembly 45 which operate substantially the same as similar baffle chambers described with respect to FIGS. 1A-1D. The RH and LH Baffle Chambers 45A, 45B are formed identically or substantially similarly to baffle chambers associated with FIGS. 1A-1D, e.g., Forward Chambers 1, 4, to include enclosing walls and a floor structure partially enclosing a space within LH and RH Baffle Chambers 45A, 45B.

Figure 4:
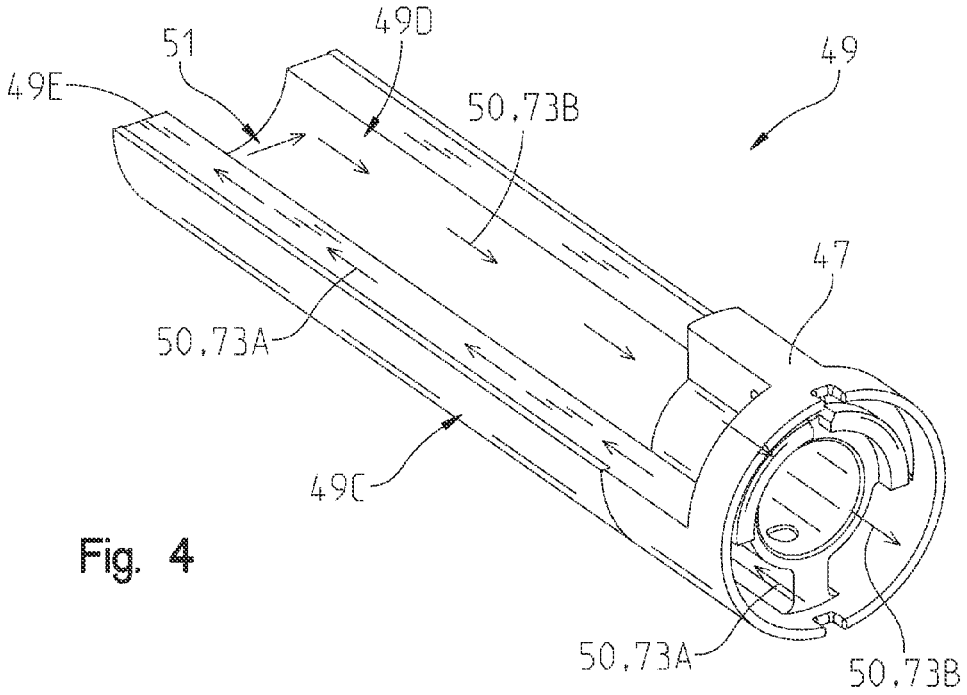
FIG. 4 shows a perspective view of an exemplary expansion chamber assembly such as shown in FIGS. 2 and 3 with a view into an exemplary PTMPGB as well as exemplary input and output ports for receiving and outputting suppressed gas path portions.

FIG. 4 shows a perspective view of Rear Assembly 49 of FIGS. 2-3. FIG. 4 shows RH Input Port/Path 73A and LH Output Port/Path 73B in a lower section of the PTMPGB 47, which is divided into two sections by an Expansion Chambers Separation Wall 49F (See FIG. 5) that extends from a bottom area of the PTMPGB 47 and continues as a lower dividing wall (49F, See FIG. 5) that extends from a Partially Cylindrically Shaped/Semi Circular Inner or Floor Wall 49D forming part of Rear Assembly 49. Input port 73A leads into a RH Expansion Chamber 49A defined by the Inner or Floor Wall 49D, First Expansion Chamber Assembly Inner or Floor Wall Extension/Cover Mating Structure 49G (See FIG. 5) which extend outwardly from the Inner or Floor Wall 49D edges in a flange form, Expansion Chambers Separation Wall 49F, and Expansion Chamber Cover 49C. Output port 73B leads out of LH Expansion Chamber 49B defined by the Inner or Floor Wall 49D, Second Expansion Chamber Assembly Inner or Floor Wall Extension/Cover Mating Structure 49H (See FIG. 5) which extend outwardly from the Inner or Floor Wall 49D edges in a flange form, Expansion Chambers Separation Wall 49F, and Expansion Chamber Cover 49C. A Rear Assembly 49 Expansion Chamber End Wall 49E extends in a semi-circular form to provide an enclosing end side to the Rear Assembly 49, and Expansion Chamber End Wall 49E couples to an end of the Inner or Floor Wall 49D, opposes a side in proximity to the PTMPGB 47, and couples to the Extension/Cover Mating Structure flanges 49G, 49H. Cover 49C is provided having a shape which form fits to enclose and seal with edges of the Extension/Cover Mating Structure flanges 49G, 49H and End Wall 49E to substantially enclose segments 73A, 73B of the Suppressed Gas Path 50 though the Rear Assembly 49. The Cover 49C can be rigid or a flexible/elastic/elastomer material.

Figure 5:
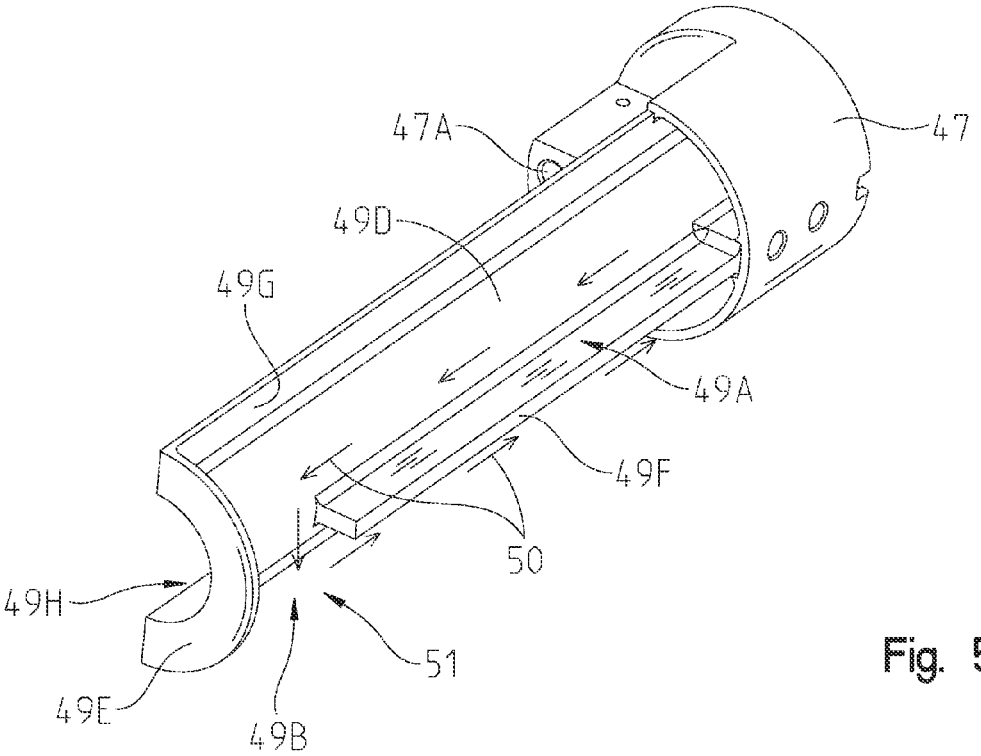
FIG. 5 shows a perspective view of a lower RH section of an exemplary expansion chamber assembly with an expansion chamber assembly cover segment removed.

FIG. 5 shows the Rear Assembly 49 from a lower RH viewpoint (from a shooter or operate view of the invention coupled to a gas powered structure, e.g., a rifle) with the Cover 49C removed. Suppressed Gas Path 50 is shown passing out and back into the PTMPGB 47 after doing a U-turn around Expansion Chamber Separation Wall 49F through Expansion Chamber Gas Pass Thru Passage 51 formed by a gap between the Separation Wall 49F and End Wall 49E. Inner or Floor Wall 49D is shown providing an inner wall to the RH and LH Expansion Chambers 49A, 49B.

Figure 6B:
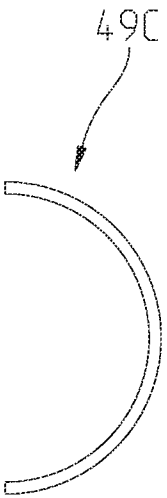
FIG. 6B shows a longitudinal side view of the FIG. 6A cover.
Figure 6A:
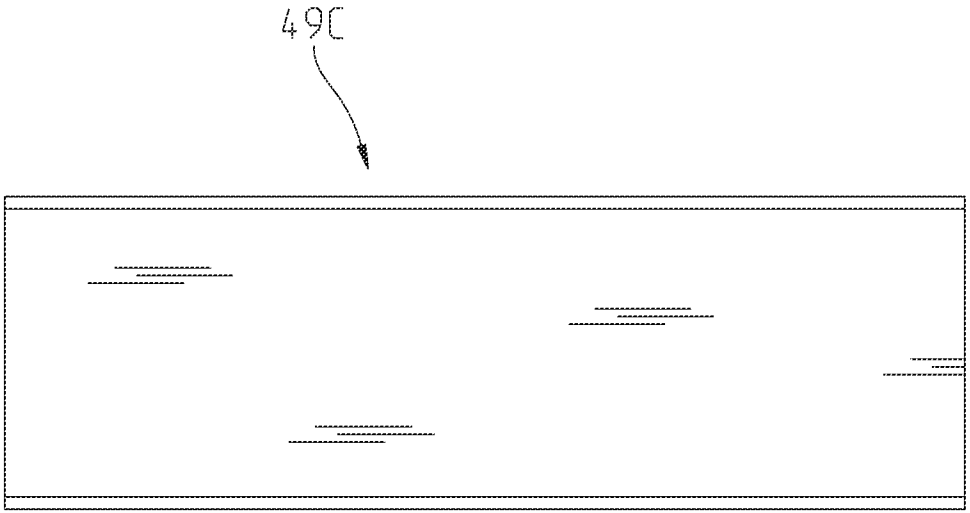
FIG. 6A shows a top view of an exemplary semi-circular expansion chamber assembly cover such as shown in FIGS. 2-5.

FIG. 6A shows a top view of Cover 49C. FIG. 6B shows a side view down the Cover 49C showing a C shaped Cover which is formed to sealingly fit to cover the RH and LH Expansion Chambers 49A, 49B. The Cover can be coupled with the Rear Assembly 49 in a variety of ways including by means of the rod structures shown in FIGS. 1A-1D or other coupling structures including hooks, latches, or adhesives. Alternative structures for Cover 49C include a tube or stretchable cover which encloses RH and LH Expansion Chambers 49A, 49B.

An embodiment of the invention can also include a structure which cycles projectile gas or air back through the suppressor chambers which increases an effective length of travel of projectile gas, both in front of a projectile as well as behind it, caused by combustion of propellant, effectively making the suppressor as effective as a longer one without adding bulk to the design.

A method of manufacture is also provided which includes providing each of the elements described herein, e.g., in FIGS. 1A-1D, and coupling them together. A method of use is also provided which includes providing an embodiment of the invention as described herein, coupling the embodiment to a gas operated system, such as a rifle or weapon, orienting the embodiment in order to open gas passages to communicate projectile or other gasses into the invention embodiment, and suppressing output of the gas operated system by routing the gas through a plurality of chambers surrounding a projectile barrel in a first path opposite a path of travel of the gas passing through the projectile barrel and then routing the gas through another plurality of chambers in a second path that is substantially opposite to the first path, wherein the chambers absorb mechanical energy of the gas, provide an expansion structure for the gas, and expel the gas in a direction which does not interfere with a sight mechanism coupled to the gas operated system, wherein the system includes a gas block adapted to have multiple gas paths including a gas path adapted to receive gas from the barrel and route it back to the gas operated system.

Although the invention has been described in detail with reference to certain preferred embodiments, variations and modifications exist within the spirit and scope of the invention as described and defined in the following claims.

The invention claimed is:

1. A gas operated projectile firing system suppressor comprising:

a suppressor structure having a first end and a second end on a side opposing said first end, wherein said suppressor structure comprises a first chamber and a second chamber, wherein said first chamber and said second chamber are formed on opposing sides of said suppressor structure, wherein said suppressor structure comprises a bore defined by an inner side wall of said suppressor structure, wherein said bore passes unobstructed from said first end of said suppressor structure through said second end through said suppressor structure along a first axis, wherein said bore is formed to receive and slide over a section of a barrel of said gas operated projectile firing system such that a muzzle is in proximity to said second end and said first end is positioned over said barrel away from said muzzle, wherein said suppressor structure is adapted to substantially surround a length of said barrel such that said second end of said suppressor structure is proximal to said muzzle but does not extend substantially beyond said muzzle, wherein said suppressor structure further comprises an adjustable coupling mechanism that is adapted to selectively fix said suppressor structure with respect to said barrel so as to prevent said suppressor structure from moving relative to said barrel in a first position and also permits said suppressor structure to rotate around said barrel in a second position;

at least one gas intake port formed into said inner side wall, wherein said gas intake port is closer to said first end of said suppressor structure than said second end of said suppressor structure, wherein said gas intake port is adapted to convey gas from a barrel port formed in a side of said barrel to a section of said suppressor structure in proximity to said second end of said first chamber;

at least one gas pass-through port formed in proximity to said first end, wherein said pass-through port is formed with a passage to convey said gas passing into said first chamber into said second chamber in proximity to said first end of said suppressor structure; and at least one exhaust port formed in a section of said second end of said suppressor structure, wherein said exhaust port is adapted to expel said gas from said second chamber and so exhaust said gas from said suppressor structure.

2. A gas operated projectile firing system suppressor as in claim 1, further comprising:

a first plurality of baffle walls positioned inside said first chamber, wherein said first plurality of baffle walls are oriented substantially perpendicular to a first gas path defining said gas movement through said first chamber to said at least one gas pass-through port, wherein at least one of said baffle walls are coupled at one side to one side of said first chamber that is substantially parallel to said first gas path, said first plurality of baffle walls are formed with a material that flexibly displaces or moves on when said gas moves along said first gas path and past said first plurality of baffle walls; and a second plurality of baffle walls positioned inside said second chamber, wherein said second plurality of baffle walls are oriented substantially perpendicular to a second gas path defining said gas movement through said second chamber to said at least one exhaust port, wherein at least one of said baffle walls are coupled at one side to one side of said second chamber that is substantially parallel to said second gas path, said second plurality of baffle walls are formed with said material that flexibly displaces or moves on when said gas moves along said second gas path and past said second plurality of baffle walls.

3. A gas operated projectile firing system suppressor as in claim 2, wherein said first chamber has at least one wall that is substantially parallel to said first axis that comprises a first elastic membrane, wherein said first elastic membrane is adapted to maintain position until at least a first force is applied by said gas along said first gas path, wherein said first elastic membrane is adapted to move or deflect when said gas traveling in said first gas path applies at least said first force to said first elastic membrane and thereby enables said gas traveling in said first gas path to pass by one end of said first plurality of baffle walls in proximity to said first elastic membrane;

wherein said second chamber has at least one wall that is substantially parallel to said first axis that comprises a second elastic membrane, wherein said second elastic membrane is adapted to maintain position until at least a second force is applied by said gas along said second gas path, wherein said second elastic membrane is adapted to move or deflect when said gas traveling in said second gas path applies at least said second force to said second elastic membrane and thereby enables said gas traveling in said second gas path to pass by one end of said second plurality of baffle walls in proximity to said first elastic membrane.

4. A gas operated projectile firing system suppressor as in claim 2, comprising:

a first elastomer cover forming a wall of one side of said first chamber that is substantially parallel to said first axis, wherein said first elastomer cover is formed over said first plurality of baffle walls; and a second elastomer cover forming a wall of one side of said second chamber that is substantially parallel to said first axis, wherein said second elastomer cover formed over said second plurality of baffle walls.

5. A gas operated projectile firing system suppressor as in claim 4, wherein said first elastomer cover and said second elastomer cover comprise a silicone based elastomer.

6. A gas operated projectile firing system suppressor as in claim 4, wherein said first elastomer cover is varied in thickness along a length of said first chamber.

7. A gas operated projectile firing system suppressor as in claim 4, wherein said second elastomer cover is varied in thickness along a length of said second chamber.

8. A gas operated projectile firing system suppressor as in claim 2, comprising an elastomer cover over said first chamber and said second chamber of said suppressor structure, wherein said elastomer cover is stretched over said first plurality of baffle walls and said second plurality of baffle walls.

9. A gas operated projectile firing system suppressor as in claim 8, wherein said elastomer cover comprises a silicone based elastomer.

10. A gas operated projectile firing system suppressor as in claim 8, wherein said elastomer cover is varied in thickness along a length of said suppressor structure.

11. A gas operated projectile firing system suppressor as in claim 1, wherein said first chamber is adapted to rotate around said barrel and thereby selectively close off conveyance of said gas from said barrel port to said first chamber via said gas intake port.

12. A gas operated projectile firing system suppressor as in claim 1, wherein said exhaust port is formed into a circumferential side of said suppressor structure that is substantially perpendicular to said first axis.

13. A gas operated projectile firing system suppressor as in claim 1, wherein said exhaust port is adapted to expel gas from said second chamber in a direction substantially parallel with said barrel.

14. A gas operated projectile firing system suppressor as in claim 1, comprising an accessory mount, wherein said accessory mount is disposed and fixed over said suppressor structure.

15. A gas operated projectile firing system suppressor as in claim 14, wherein said accessory mount comprises venting apertures adapted to allow air circulation around said suppressor structure.

16. A gas operated projectile firing system suppressor as in claim 14, wherein said accessory mount comprises at least one heat reflector.

17. A gas operated projectile firing system suppressor as in claim 1, wherein said suppressor structure is adapted to substantially surround a length of said barrel such that said second end of said suppressor structure is proximal to said muzzle but does not extend beyond said muzzle by a length greater than twenty percent of the length of said suppressor structure.

18. A gas operated projectile firing system suppressor comprising:

a suppressor structure having a first end and a second end on a side opposing said first end, wherein said suppressor structure comprises a first chamber and a second chamber, wherein said first chamber and said second chamber formed on opposing sides of said suppressor structure, wherein said suppressor structure comprises a bore defined by an inner side wall of said suppressor structure, wherein said bore passes unobstructed from said first end of said suppressor structure through said second end through said suppressor structure along a first axis, wherein said bore is formed to receive and slide over a section of a barrel of said gas operated projectile firing system such that a muzzle is in proximity to said second end and said first end is positioned over said barrel away from said muzzle, wherein said suppressor structure is adapted to substantially surround a length of said barrel such that said second end of said suppressor structure is proximal to said muzzle but does not extend substantially beyond said muzzle, wherein said suppressor structure further comprises an adjustable coupling mechanism that is adapted to selectively fix said suppressor structure with respect to said barrel so as to prevent said suppressor structure from moving relative to said barrel in a first position and also permits said suppressor structure to rotate around said barrel in a second position;

at least one gas intake port formed into said inner side wall, wherein said gas intake port is closer to said first end of said suppressor structure than said second end of said suppressor structure, wherein said gas intake port is adapted to convey gas from a barrel port formed in a side of said barrel to a section of said suppressor structure in proximity to said second end of said first chamber;

at least one gas pass-through port formed in proximity to said first end, wherein said pass-through port is formed with a passage to convey said gas passing into said first chamber into said second chamber in proximity to said first end of said suppressor structure;

at least one exhaust port formed in a section of said second end of said suppressor structure, wherein said exhaust port is adapted to expel said gas from said second chamber and so exhaust said gas from said suppressor structure;

a first plurality of baffle walls positioned inside said first chamber, wherein said first plurality of baffle walls are oriented substantially perpendicular to a first gas path defining said gas movement through said first chamber to said at least one gas pass-through port, wherein at least one of said baffle walls are coupled at one side to one side of said first chamber that is substantially parallel to said first gas path, said first plurality of baffle walls are formed with a material that flexibly displaces or moves on when said gas moves along said first gas path and past said first plurality of baffle walls; and a second plurality of baffle walls positioned inside said second chamber, wherein said second plurality of baffle walls are oriented substantially perpendicular to a second gas path defining said gas movement through said second chamber to said at least one exhaust port, wherein at least one of said baffle walls are coupled at one side to one side of said second chamber that is substantially parallel to said second gas path, said second plurality of baffle walls are formed with said material that flexibly displaces or moves on when said gas moves along said second gas path and past said second plurality of baffle walls;

wherein said first chamber has at least one wall that is substantially parallel to said first axis that comprises a first elastic membrane, wherein said first elastic membrane is adapted to maintain position until at least a first force is applied by said gas along said first gas path, wherein said first elastic membrane is adapted to move or deflect when said gas traveling in said first gas path applies at least said first force to said first elastic membrane and thereby enables said gas traveling in said first gas path to pass by one end of said first plurality of baffle walls in proximity to said first elastic membrane;

wherein said second chamber has at least one wall that is substantially parallel to said first axis that comprises a second elastic membrane, wherein said second elastic membrane is adapted to maintain position until at least a second force is applied by said gas along said second gas path, wherein said second elastic membrane is adapted to move or deflect when said gas traveling in said second gas path applies at least said second force to said second elastic membrane and thereby enables said gas traveling in said second gas path to pass by one end of said second plurality of baffle walls in proximity to said first elastic membrane.

19. A gas operated projectile firing system suppressor as in claim 18, wherein said first chamber is adapted to rotate around said barrel and thereby selectively close off conveyance of said gas from said barrel port to said first chamber via said gas intake port.

20. A gas operated projectile firing system suppressor as in claim 18, wherein said exhaust port is formed into a circumferential side of said suppressor structure that is substantially perpendicular to said first axis.

21. A gas operated projectile firing system suppressor as in claim 18, wherein said exhaust port is adapted to expel gas from said second chamber in a direction substantially parallel with said first axis.

22. A gas operated projectile firing system suppressor as in claim 18, comprising an accessory mount, wherein said accessory mount is disposed and fixed over said suppressor structure.

23. A gas operated projectile firing system suppressor as in claim 22, wherein said accessory mount comprises venting apertures adapted to allow air circulation around said suppressor structure.

24. A gas operated projectile firing system suppressor as in claim 22, wherein said accessory mount comprises at least one heat reflector.

25. A gas operated projectile firing system suppressor as in claim 18, wherein said suppressor structure is adapted to substantially surround a length of said barrel such that said second end of said suppressor structure is proximal to said muzzle but does not extend beyond said muzzle by a length greater than twenty percent of the length of said suppressor structure.

26. A gas operated projectile firing system suppressor comprising:

a suppressor structure comprising a first section and a second section on an opposing end of said suppressor structure, wherein said suppressor structure comprises a first chamber, a second chamber, and a third chamber, wherein said first chamber and said third chamber are formed along opposing sides of said first section of said suppressor structure, wherein said second chamber is formed in proximity to and within said second section of said suppressor structure, wherein said suppressor structure further comprises a bore through an interior of said suppressor structure defined by an inner side wall of said suppressor structure, wherein said bore passes from a first end wall of said first section of said suppressor structure through a second end wall said second section of said suppressor structure, wherein said bore forms an unobstructed passage through said suppressor structure, wherein said bore is adapted to slide over a barrel of said gas operated projectile firing system that comprises a muzzle section defining an opening for said projectile to exit said barrel, wherein said suppressor structure is adapted to substantially surround a length of said barrel, wherein said suppressor structure further comprises a friction structure adapted to apply a movement locking force to said barrel and to fix said suppressor structure in place relative to said barrel;

at least one gas intake port formed into said inner side wall in proximity to said first section, wherein said gas intake port is adapted to convey said gas from a barrel gas port formed in a side of said barrel into a projectile firing bore in said barrel to a first end of said first chamber in proximity to said first section;

at least one first gas pass-through port, wherein said first gas pass-through port is formed with a passage to convey said gas from said first chamber to said second chamber;

at least one second gas pass-through port, wherein said second gas pass-through port is formed with another passage to convey said gas in said second chamber to said third chamber; and at least one exhaust port, wherein said exhaust port is adapted to expel said gas from said third chamber so as said gas is exhausted from said suppressor structure, wherein said exhaust port in proximity to said first section.

27. A gas operated projectile firing system suppressor as in claim 26, comprising:

at least one or more baffle walls formed inside said first chamber and coupled to one side of said first chamber, wherein said at least one or more baffle walls are oriented substantially perpendicular to a first axis defined by a first gas path from said gas intake port to said first gas pass through port;

at least one or more second baffle walls formed inside said second chamber and coupled to one side of said second chamber, wherein said at least one or more second baffle walls are oriented substantially perpendicular to a second axis defined by a second gas path from said first gas pass through port to said at least one second gas pass-through port; and at least one or more third baffle walls formed inside said third chamber and coupled to one side of said third chamber, wherein said at least one or more third baffle walls are oriented substantially perpendicular to a third axis defined by a third gas path from said second gas pass-through port to said at least one exhaust port.

28. A gas operated projectile firing system suppressor as in claim 27:

wherein one side of said first chamber comprises a first elastomer cover over said first chamber, wherein said first elastomer cover is formed over said first plurality of baffle walls; and wherein one side of said first chamber comprises a second elastomer cover over said third chamber, wherein said second elastomer cover is formed over said third plurality of baffle walls.

29. A gas operated projectile firing system suppressor as in claim 26, wherein said first chamber is adapted to rotate around said barrel and thereby close off conveyance of gas from said barrel port to said first chamber via said gas intake port.

30. A gas operated projectile firing system suppressor as in claim 26, wherein said exhaust port is formed into a circumferential side of said suppressor structure.

31. A gas operated projectile firing system suppressor as in claim 26, wherein said exhaust port is adapted to expel said gas from said third chamber in a direction substantially parallel with said barrel.

32. A gas operated projectile firing system suppressor as in claim 26, comprising an accessory mount, wherein said accessory mount is disposed and fixed over and surrounding at least a portion of said suppressor structure.

33. A gas operated projectile firing system suppressor as in claim 32, wherein said accessory mount comprises venting apertures adapted to allow air circulation around said suppressor structure.

34. A gas operated projectile firing system suppressor as in claim 32, wherein said accessory mount comprises at least one heat reflector.

35. A gas operated projectile firing system suppressor as in claim 32, wherein said suppressor structure is adapted to substantially surround a length of said barrel such that said first end of said suppressor structure is proximal to said muzzle but does not extend beyond said muzzle by a length greater than twenty percent of the length of said suppressor structure.

36. A method of using a gas operated projectile firing system suppressor comprising:

providing a gas operated projectile firing system suppressor comprising:

a suppressor structure having a first end and a second end on a side opposing said first end, wherein said suppressor structure comprises a first chamber and a second chamber, wherein said first chamber and said second chamber formed on opposing sides of said suppressor structure, wherein said suppressor structure comprises a bore defined by an inner side wall of said suppressor structure, wherein said bore passes unobstructed from said first end of said suppressor structure through said second end through said suppressor structure along a first axis, wherein said bore is formed to receive and slide over a section of a barrel of said gas operated projectile firing system such that a muzzle is in proximity to said second end and said first end is positioned over said barrel away from said muzzle, wherein said suppressor structure is adapted to substantially surround a length of said barrel such that said second end of said suppressor structure is proximal to said muzzle but does not extend substantially beyond said muzzle, wherein said suppressor structure further comprises an adjustable coupling mechanism that is adapted to selectively fix said suppressor structure with respect to said barrel so as to prevent said suppressor structure from moving relative to said barrel in a first position and also permits said suppressor structure to rotate around said barrel in a second position;

at least one gas intake port formed into said inner side wall, wherein said gas intake port is closer to said first end of said suppressor structure than said second end of said suppressor structure, wherein said gas intake port is adapted to convey gas from a barrel port formed in a side of said barrel to a section of said suppressor structure in proximity to said second end of said first chamber;

at least one gas pass-through port formed in proximity to said first end, wherein said pass-through port is formed with a passage to convey said gas passing into said first chamber into said second chamber in proximity to said first end of said suppressor structure; and at least one exhaust port formed in a section of said second end of said suppressor structure, wherein said exhaust port is adapted to expel said gas from said second chamber and so exhaust said gas from said suppressor structure;

providing said barrel of said gas operated system;

sliding said gas operated projectile firing system suppressor over said barrel until said gas operated projectile firing system suppressor substantially surrounds said barrel;

aligning said gas intake port with said barrel port such that said gas intake port is positioned to convey said gas from said barrel to said first chamber; and coupling said gas operated projectile firing system suppressor to said barrel by said adjustable coupling mechanism.

37. The method of using a gas operated projectile firing system suppressor of claim 36, wherein said gas operated projectile firing system suppressor is slid over said barrel until said gas operated projectile firing system suppressor does not extend beyond said muzzle by a length greater than twenty percent of the length of said suppressor structure.

38. The method of using a gas operated projectile firing system suppressor of claim 36, wherein said gas operated projectile firing system suppressor's adjustable coupling mechanism comprises a set screw.

39. The method of using a gas operated projectile firing system suppressor of claim 36, further comprising:

providing and coupling an accessory mount to said gas operated projectile firing system over said gas operated projectile firing system suppressor.

40. The method of using a gas operated projectile firing system suppressor of claim 36, wherein aligning said gas intake port with said barrel port comprises rotating said first chamber around said barrel.

41. The method of using a gas operating projectile firing system suppressor of claim 36, wherein said suppressor further comprises:

a first plurality of baffle walls positioned inside said first chamber, wherein said first plurality of baffle walls are oriented substantially perpendicular to a first gas path defining said gas movement through said first chamber to said at least one gas pass-through port, wherein at least one of said baffle walls are coupled at one side to one side of said first chamber that is substantially parallel to said first gas path, said first plurality of baffle walls are formed with a material that flexibly displaces or moves on when said gas moves along said first gas path and past said first plurality of baffle walls; and a second plurality of baffle walls positioned inside said second chamber, wherein said second plurality of baffle walls are oriented substantially perpendicular to a second gas path defining said gas movement through said second chamber to said at least one exhaust port, wherein at least one of said baffle walls are coupled at one side to one side of said second chamber that is substantially parallel to said second gas path, said second plurality of baffle walls are formed with said material that flexibly displaces or moves on when said gas moves along said second gas path and past said second plurality of baffle walls.

42. The method of using a gas operating projectile firing system suppressor of claim 36, wherein said first chamber has at least one wall that is substantially parallel to said first axis that comprises a first elastic membrane, wherein said first elastic membrane is adapted to maintain position until at least a first force is applied by said gas along said first gas path, wherein said first elastic membrane is adapted to move or deflect when said gas traveling in said first gas path applies at least said first force to said first elastic membrane and thereby enables said gas traveling in said first gas path to pass by one end of said first plurality of baffle walls in proximity to said first elastic membrane;

wherein said second chamber has at least one wall that is substantially parallel to said first axis that comprises a second elastic membrane, wherein said second elastic membrane is adapted to maintain position until at least a second force is applied by said gas along said second gas path, wherein said second elastic membrane is adapted to move or deflect when said gas traveling in said second gas path applies at least said second force to said second elastic membrane and thereby enables said gas traveling in said second gas path to pass by one end of said second plurality of baffle walls in proximity to said first elastic membrane.

43. The method of using a gas operating projectile firing system suppressor of claim 36, wherein said suppressor further comprises:

a first elastomer cover forming a wall of one side of said first chamber that is substantially parallel to said first axis, wherein said first elastomer cover is formed over said first plurality of baffle walls; and a second elastomer cover forming a wall of one side of said second chamber that is substantially parallel to said first axis, wherein said second elastomer cover formed over said second plurality of baffle walls.

44. A projectile firing structure comprising:

a first section comprising a barrel structure having a first end and a second end on an opposing side of said barrel structure, said barrel structure further comprising a barrel wall and a plurality of gas ports formed into said barrel wall, said plurality of gas ports comprising a first gas port, said first gas port is adapted to convey gas that is in said barrel structure that is compressed and dispelled during passage of a projectile through said barrel structure, said first gas port is formed in said barrel structure closer to said first end than said second end;

a second section adapted to slide over said first end of said barrel structure and coupled with said first end of said barrel structure, said second section comprising a structure with a plurality of chamber sections, said plurality of chamber sections comprising a first, second and third chamber section, said first chamber section is adapted to receive said gas from at least said first gas port, said first chamber section is further adapted to deflect and disperse said gas received from said first gas port, wherein said first chamber is also adapted to enable rotation of said second section around said barrel structure and thereby close off gas communication with said first gas port, said second chamber comprises a manifold adapted to receive deflected and dispersed gas from said first chamber and enable expansion of said deflected and dispersed gas into said second chamber, said third chamber comprised of third chamber sections each separated by at least one of a plurality of elastic membranes adapted to maintain position until at least one force is applied, said third chamber is adapted to receive said expanded gas from said second chamber, said elastic membranes are adapted to move or deflect when said expanded gas applies at least said first force to said elastic membrane and thereby enable said expanded gas to pass past said membrane, said expanded gas that passes past all said membranes are exhausted out of a plurality of exhaust ports formed into a circumferential side of said second section.

45. A projectile firing structure as in claim 44, wherein said second chamber's manifold comprises a first and second manifold section within a cylindrical section of said second chamber which is adapted to receive said deflected and dispersed gas which passes through said cylindrical section then is routed to said third section.

* * * * *